United States Patent [19]

Gerber

[11] Patent Number: 4,603,790

[45] Date of Patent: Aug. 5, 1986

[54] TENSIONED RESERVOIR COVER, RAINWATER RUN-OFF ENHANCEMENT SYSTEM

[75] Inventor: Dennis H. Gerber, Los Gatos, Calif.

[73] Assignee: Burke Industries, Inc., San Jose, Calif.

[21] Appl. No.: 710,167

[22] Filed: Mar. 11, 1985

[51] Int. Cl.[4] ..... B65D 88/38

[52] U.S. Cl. ..... 220/219; 220/216

[58] Field of Search ..... 220/216–227; 210/DIG. 9

[56] References Cited

U.S. PATENT DOCUMENTS

| | | | |
|---|---|---|---|
| 3,517,513 | 6/1970 | Renshaw et al. | 220/218 |
| 3,592,009 | 7/1971 | Ackmaar et al. | 220/219 |
| 3,991,900 | 11/1976 | Burke et al. | 220/219 |
| 4,139,117 | 2/1979 | Dial | 220/221 |
| 4,446,983 | 5/1984 | Gerber | 220/219 |
| 4,476,992 | 10/1984 | Gerber | 220/219 |

*Primary Examiner*—Joseph Man-Fu Moy

*Attorney, Agent, or Firm*—James R. Cypher

[57] ABSTRACT

A rainwater run-off enhancement system for flexible reservoir covers which have substantial portions which are horizontal and in two way tension forming large flat areas. Elongated weights are placed on the flat areas forming depressions which collect and channel rainwater which flows into sumps formed in the cover.

2 Claims, 7 Drawing Figures

TENSIONED RESERVOIR COVER, RAINWATER RUN-OFF ENHANCEMENT SYSTEM

BACKGROUND OF THE INVENTION

Tensioned flexible covers for reservoirs are illustrated in Gerber U.S. Pat. No. 4,476,992 granted Oct. 16, 1984 and Gerber U.S. Pat. No. 4,446,983 granted May 8, 1984. Both of these flexible covers provide weights which cause rainwater sumps to form at specified locations and tension the horizontal portions of the cover. Water, which is deposited on the surface of the cover in the form of rainfall, drains into the sumps. Some of the reservoir covers have surfaces which cover several acres and the distance traveled by rain falling on the surface may travel up to several hundred feet before dropping into a sump. It may take several hours for the water to travel to a sump. If the temperatures are below freezing, ice may form where the water is particularly slow moving. Such buildup of ice may be a problem to a flexible cover.

Flexible covers which cover large reservoirs and have very large flat areas, are also subject to the deposit of wind blown sand and debris which sometimes collects and weighs down the cover in localized places thereby causing the formation of random depressions which collect rainwater in puddles. These puddles progressively become larger as rainwater accumulates and if the weight of the debris is great enough, the water can be prevented from reaching the sumps. This accumulation of water can be subject to freezing and in some cases can cause distortion of the cover and interfere with the operation of the connecting rainwater sumps.

Another problem which has been noted with flexible reservoir covers which are located in areas subject to occasional high wind velocities is the problem of cover lift-off. Lift-off or cover billowing can occur if air is permitted to enter underneath the cover at the perimeter connection points or through air vents which are normally used to expel air or lighter than air gases trapped beneath the cover. High winds blowing across a reservoir can create negative air pressure above the cover while at the same time it may force air below the cover. Such an adverse condition can cause the cover to lift off the surface and instances of a cover flapping twenty to thirty feet in the air have occurred and damaged the flexible cover.

Finally, flexible covers are custom fitted to cover reservoirs with asymetrical or irregular shapes. It is almost impossible to design tight fitting covers in some of the corners or bays of such reservoirs and some random wrinkling and folding can occur which results in barriers to the free flow of the rainwater toward the sumps and traps wind blown debris. Prior to the present invention, no solution to the above problems has been set forth.

SUMMARY OF THE INVENTION

This invention consists of the addition of small elongated biasing weights on top of or underneath the flexible cover in selected locations which create slight depressions in the surface of the flexible membrane sheeting which terminate adjacent the linear sumps formed in the cover. These elongated small depressions thus become shallow rainwater channels which lead to the main inter-connected rainwater sumps.

The main object of the present invention is to enhance the run-off of rainwater from the tensioned flat portions of flexible reservoir covers. Enchancing the flow of rainwater decreases the likelihood and/or amount of ice formation and its attendant problems.

The use of the enhancement weights also reduces wrinkling and random folds in areas of the cover which are difficult to conform exactly to the irregular form of the reservoir.

The use of additional enchancement weights further enchances the tautness of the cover and assists in removing slack, thereby insuring that the top surface is an absolutely true flat surface from which any collected rainwater will run off naturally.

The use of rainwater enhancement weights reduces the possibility of cover lift-off and the possible destruction of the cover. The additional weight is important in preventing lift-off of the cover but primarily, by keeping the cover in contact with the surface of the fluid, the effectiveness of the surface tension hold-down phenomenon is greatly increased.

DESCRIPTION OF THE PREFERRED EMBODIMENTS

Figure 1:
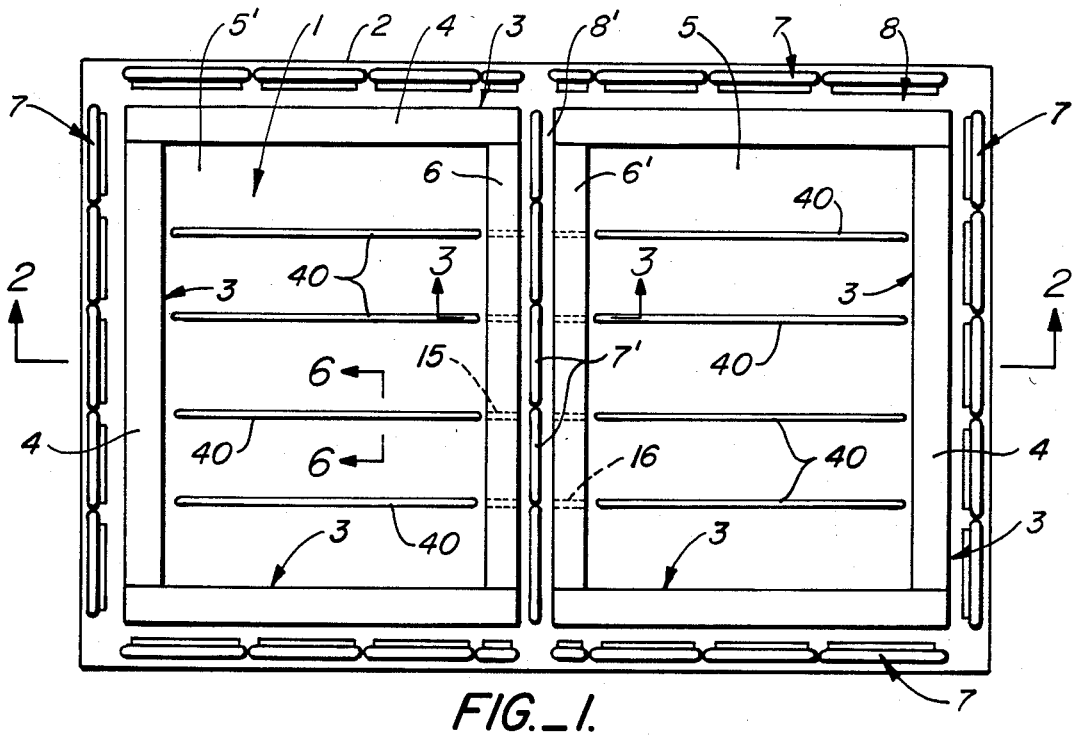
FIG. 1 is a top plan view of a reservoir with a cover of the present invention placed on the bottom.
Figure 2:
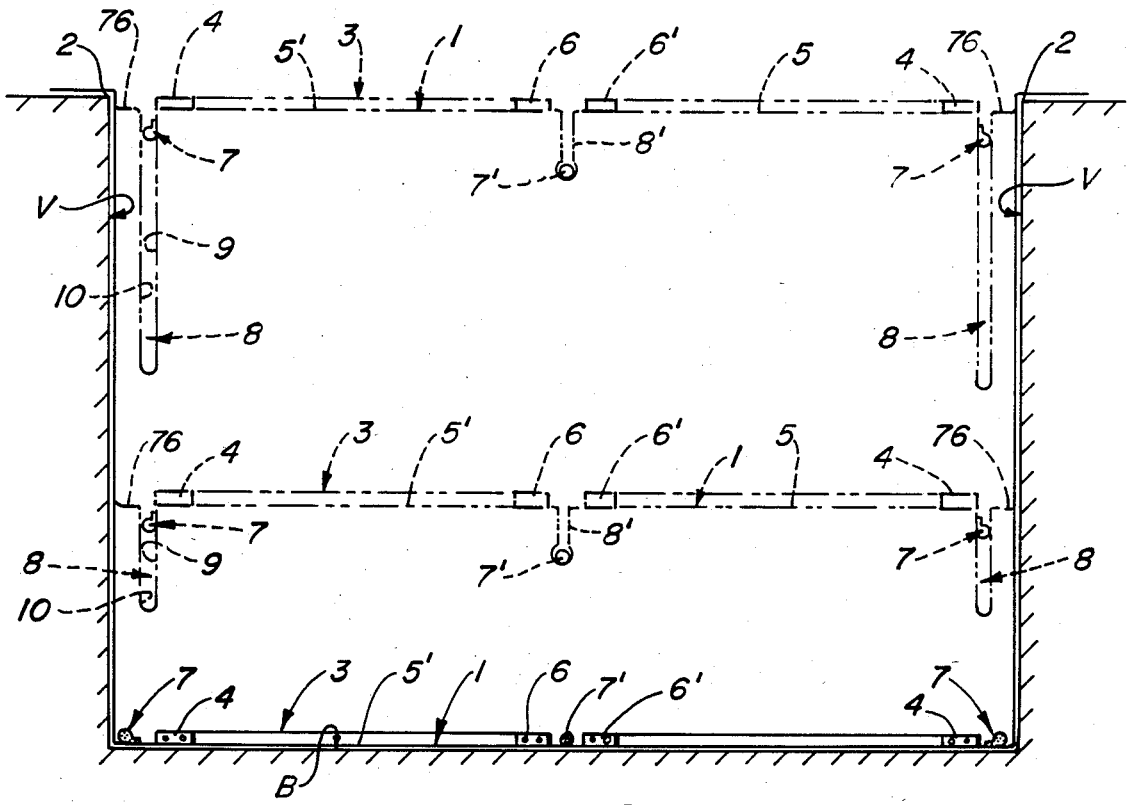
FIG. 2 is a cross sectional view of the reservoir of FIG. 1 taken along line 2—2. The solid lines show the cover and float system resting on the bottom of the reservoir. The broken lines show the position of the float system when the reservoir is partially filled with fluid and when completely filled.
Figure 3:
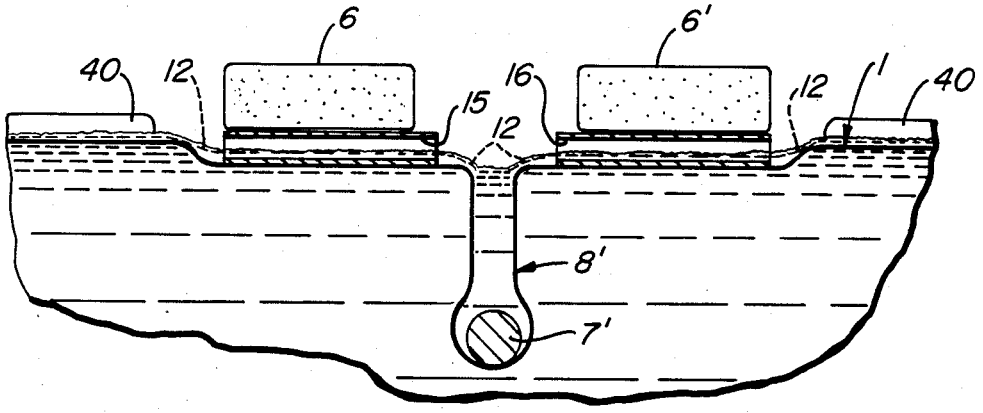
FIG. 3 is a cross sectional view on an enlarged scale of a portion of the cover taken generally along line 3—3 of FIG. 1.

Referring to FIGS. 1, 2 and 3, a reservoir cover 1 is illustrated equipped with a rainwater run-off enhancement system. The reservoir cover consists briefly of a flexible generally fluid impermeable material which is attached to the periphery 2 of the reservoir by any of several standard techniques. The cover is one or more sheets made up of many smaller strips joined together and dimensioned to completely cover and lie in surface contact with the vertical walls V or slope sided wall S and bottom B of the reservoir when it is empty. Float means 3 are attached to and buoyantly carry at least the entire border area 4 of a central portion 5 of the cover. One or more transverse floats 6 and 6' may be used to stablize the central area. Weight means 7 are affixed to the cover outwardly of and substantially entirely surrounding the central portion and are positioned adjacent the float means in the border area so as to tension the entire central portion in both horizontal directions at all working levels of the reservoir. The weight means and the float means are positioned so as to form a defined peripheral sump 8 immediately adjacent and around the entire border area of the central portion.

The sump has an inner sidewall 9 and an outer sidewall 10 in which the inner sidewall is in tension. In FIG. 2, the outer sidewall is not tensioned by weight 7. The weight means preferably is connected to the portion of the cover which lies in surface contact with the bottom of the reservoir when it is empty. The weight means are interrupted at the corners so that as the reservoir fills, they will not come in contact with one another. The weight means may be constructed from the same material as the cover in a tubular elongated form and filled with any material heavier than the fluid in the reservoir. Sand is an inexpensive material which may be used. The weight means may be continuously attached to the cover or strapped at intervals. The weights may be attached to either the top or bottom side of the cover. The weight means should be attached at a convenient distance from the end of the float means so that workmen can attach the weight at the reservoir site and also inspect it from time to time.

The cover may be made from Hypalon, a DuPont trademark or other rubber or plastic material. The float material may be any standard buoyant means used by the industry in constructing reservoir covers. The floats may be attached to either the top or bottom of the cover.

Referring to FIG. 2, as water or other fluid is pumped into the reservoir beneath the cover, the float means and displacement of the fluid causes the cover to lift at the perimeter of the central area. The weight means prevents the cover from lifting initially from the bottom of the reservoir and the sump 8 is immediately formed. The phantom lines show the position of the cover, floats, weights and sump when the reservoir is partially full. Note that the weight does not place any tension on the outer sidewall of the sump or the peripheral portion of the cover.

As the reservoir fills and reaches its maximum fill level, the upper phantom lines indicate the position of the cover, floats, weight means and sump. The sump is at its maximum depth and only the upper portion of the inner sidewall 9 is tensioned by the weight means. The outer sidewall 10 and peripheral portion 76 of the cover are not tensioned by the weight means. The central portion of the cover may be a single portion or if the reservoir is very large, it may be divided into two or more sections. As shown in FIG. 1, the cover is divided into two portions 5 and 5'. Weights 7' are used to form a transverse sump 8'.

During the filling of the reservoir, the central portions 5 and 5' are placed in tension in both horizontal directions. Thus, rainwater which falls upon the cover immediately seeks the lowest point of the cover which is the periphery of the central area. In order to enhance the run-off, a plurality of rainwater enhancement run-off weights 40 are placed either on top or beneath the cover. Weights 40 are substantially lighter than weights 7 and 7' which form the sumps so that they will not be able to depress the cover a sufficient amount so as to raise the sump weights up to the surface. Weights 40 may be constructed in the same manner as sump weights 7 and 7' except that as previously stated, they are lighter in weight. The weights 40 should depress the cover only slightly so that surface water will flow to the depression made by the weights 40 and will then flow toward the sumps 8 and 8'.

FIG. 3 illustrates the operation of the cover in permitting rainwater from a portion of the central portion of the cover to move along run-off enhancement weight 40, pass under floats 6' and into middle sump 8'. Short lengths of plastic pipe 15 and 16 may be placed beneath the floats in the vicinity of the run-off weights 40 so that surface water 12 will flow therethrough and into the sump 8'. Mid sump 8' connects with and permits rainwater to flow into the periphery sumps 8 where it is either pumped out or passed down through a drain in the bottom of the reservoir. Water can flow into the sumps by simply leaving gaps in the floats.

As illustrated in FIGS. 1 and 2, portions 76 of the periphery of the cover are not in tension. No rainwater run-off enhancement weights would be used at the cover periphery. If, however, the weight 7 were placed in the bottom of the sump or an additional weight was placed on side 10 of the sump, then portions of the cover 76 would be in tension and assuming there was a considerable distance to the side of the reservoir, then further run-off weights similar to weights 40 could be used. Such weights, for example, would extend from the periphery of the reservoir to perimeter sumps 8.

Figure 4:
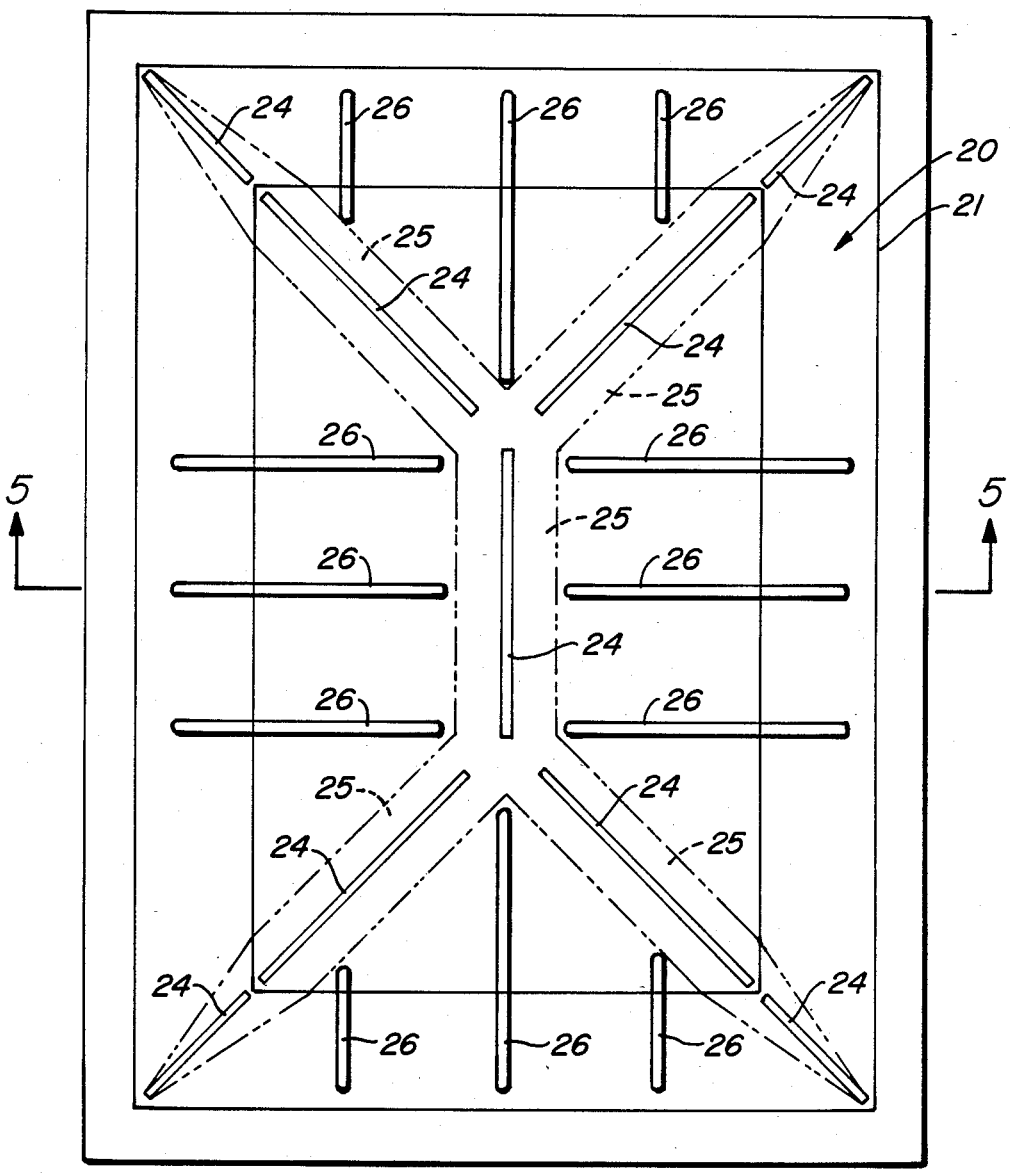
FIG. 4 is a plan view of a reservoir showing another form of cover using the enhanced run-off weights of the present invention.
Figure 5:
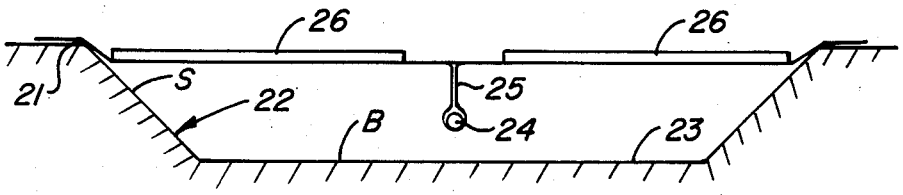
FIG. 5 is a cross sectional view of the reservoir of FIG. 4 taken along line 5—5 of FIG. 4.

Referring to FIGS. 4 and 5, another form of reservoir cover is illustrated which uses the run-off enhancement weights of the present invention. A cover 20 is shown which is made from a flexible rubber or plastic material. The edges of the cover are affixed to the periphery 21 of the reservoir having sloped or vertical sides 22 and a bottom 23. The cover is dimensioned so that when the reservoir is empty, the cover will rest on the sides and bottom of the reservoir. Sump weights 24 are attached or placed on the cover as illustrated so that when the reservoir is filled with fluid, all horizontal portions of the cover will be placed in tension. The placement of these sump weights is disclosed in Gerber, U.S. Pat. No. 4,476,992. When fluid is placed in the reservoir beneath the cover, sumps 25 are formed. The weights 24 also cause the horizontal portions of the cover to be placed in tension so that when rain falls upon the cover, the water will slowly flow toward the lowest portion of the cover which will be the sumps 25. In order to speed up or enhance the flow of surface water to the sumps 25, elongated rainwater run-off enhancement weights 26 are placed on the horizontal portions of the cover so that they will depress the cover slightly and water from adjacent horizontal cover portions will flow toward the depression. The collected water then flows into the nearest sump 25.

Figure 6:
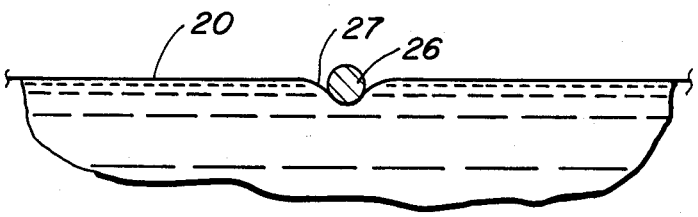
FIG. 6 is a cross sectional view of a portion of the cover shown in FIG. 1 taken along line 6—6.

A typical run-off weight 24 is illustrated in FIG. 6. The weight may be placed on top of the cover to form a depression 27 or it may be attached to the cover by suitable means.

Figure 7:
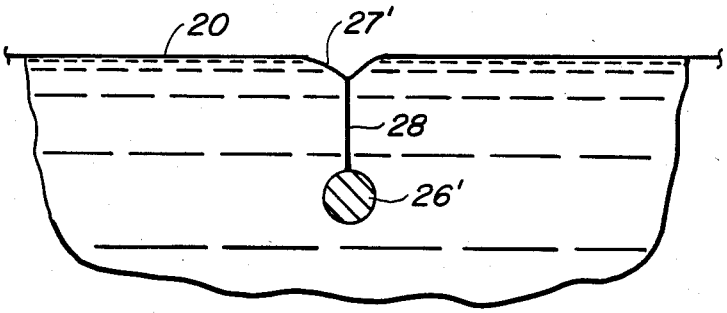
FIG. 7 is a cross sectional view of another form of the invention taken along the same line as FIG. 6—6 in FIG. 1.

FIG. 7 illustrates another way to attach a rainwater enhancement weight 26' to the cover. The weight 26' may be attached to the underside of the cover by a cord 28 or flap of the cover itself. The weight will form a depression 27' in the cover and rainwater will flow into this depression. Rainwater collected in the depression will flow into the sump 25 as previously explained. It should be noted that a separate weight 26' need not be used. A flap 28 of the cover material itself hanging downwardly will provide enough weight to cause a depression 27' in the surface of the cover.

Operation of the cover shown in FIGS. 4 and 5 is as follows. Sump weights 24 cause all horizontal portions of the cover to be placed in tension. This tension is preferably of an amount so that a workman standing on a horizontal portion would be supported. Because the horizontal portions are in tension and in contact with the surface of the water, these portions will be perfectly flat. When rainfalls on the horizontal portions of the cover, the water seeks the lowest point and in this case it will be the depressions 27 beneath weights 26. As water accumulates in the depressions 27, it also flows toward sumps 25 which are formed by sump weights 24. Water is either pumped from the interconnecting sumps 25 or it may flow down through a tube in the bottom of the reservoir.

The enhancement weights need not necessarily be straight, but this would be the preferred form in directing surface water to the sumps. The geometric pattern of rain enhancement sumps need not be the one illustrated in the drawings. For example, in FIG. 1, the enhancement weights could be a plurality of short weights intersecting the perimeter float members. The object of the invention is to develop a series of depressions in the tensioned horizontal portions of the cover which will carry the surface water to the sumps in the shortest possible time. The enhancement weights should terminate as close to the sumps as possible.

The enhancement weights have a lineal per foot weight substantially less than the per lineal foot weight of the sump weighting means. In this way, the enhancement weights will not form a depression so great as to cause the sump weights to be raised to the surface.

The enhancement weights may have a per lineal foot weight that actually varies. For example, the weight could be made so that it is progressively heavier as it approaches the sump. In this way, a great depression would be made, the closer the enhancement weight was to the sump. This could enable the depressions made by the enhancement weights to carry the greater volume of water collected from the horizontal tensioned cover portions as the water approaches the sump.

I claim:

1. A rainwater run-off enhancement system for tensioned reservoir covers comprising:

a. a flexible cover member of substantially fluid impervious material of sufficient area to cover said reservoir;

b. means connecting the perimeter of said cover member to the perimeter of said reservoir;

c. sump weighting means positioned with respect to said cover member at the pre-selected positions;

d. a plurality of cover sump portions formed in said cover by said weighting means, each of said sump portions being defined, narrow, elongated and interconnected and having generally vertical sidewalls in tension and having a selected location for all working fill levels of said reservoir;

e. a plurality of generally horizontal cover portions formed in said cover by said weighting means, each of said horizontal cover portions having a selected geometric shape and positioned at a selected location for all working fill levels of said reservoir and all of said horizontal cover portions are in tension in at least two different horizontal directions of sufficient magnitude to permit workmen to traverse all portions of said horizontal cover portions for all working fill levels with said horizontal cover remaining substantially planar in sustaining the weight of the workmen;

f. said horizontal cover portions are bordered by said reservoir perimeter and said sump portions and cover substantially all of the surface of said reservoir for all working fluid level conditions;

g. a plurality of rain enhancement elongated weight means having a lineal per foot weight substantially less than the per lineal foot weight of said sump weighting means;

h. said rain enhancement weight means are positioned with respect to said tensioned horizontal cover portions so as to form elongated depressions terminating adjacent said cover sump portions for directing surface water into said sump portions.

2. A rainwater run-off enhancement system for tensioned reservoir covers comprising:

a. said cover is substantially a fluid impervious sheet and is attached to the periphery of said reservoir and has an area dimensioned to cover said reservoir during all working fill levels;

b. said cover includes a central portion covering a substantial portion of said reservoir surface;

c. float means buoyantly carrying at least portions of substantially the entire border area of said central portion of said cover;

d. sump weight means affixed to said cover outwardly of said border area of said central portion and outwardly of said float means around substantially said entire central portion so as to place substantially all of said central portion inwardly of said border area in tension in at least two different horizontal directions of sufficient magnitude to permit workmen to traverse all portions of said central portion of said horizontal cover for all working levels with said central horizontal portion remaining substantially planar in sustaining the weight of the workmen at all working levels of said reservoir;

e. said weight means and said float means are positioned so as to initiate and form a defined peripheral sump outwardly and immediately adjacent said entire border area of said central portion to receive surface water from said central portion;

f. said peripheral sump having inner and outer sidewalls on which at least the upper portion of said inner sidewall between said float means and said weight means is in tension;

g. a plurality of rain enhancement elongated weight means having a lineal per foot weight substantially less than the per lineal foot weight of said sump weighting means;

h. said rain enhancement weight means are positioned with respect to said tensioned central portion so as to form elongated depressions terminating adjacent said peripheral sump for directing surface water into said sump portions.

* * * * *